United States Patent [19]

Cipriano

[11] Patent Number: 5,071,581

[45] Date of Patent: Dec. 10, 1991

[54] ELECTRORHEOLOGICAL FLUIDS BASED ON CROWN ETHERS AND QUATERNARY AMINES

[75] Inventor: Robert A. Cipriano, Lake Jackson, Tex.

[73] Assignee: The Dow Chemical Company, Midland, Mich.

[21] Appl. No.: 627,290

[22] Filed: Dec. 14, 1990

Related U.S. Application Data

[63] Continuation-in-part of Ser. No. 486,656, Mar. 1, 1990, abandoned.

[51] Int. Cl.[5] ..... H01B 3/20; C09K 3/00

[52] U.S. Cl. ..... 252/77; 252/73; 252/572

[58] Field of Search ..... 252/73, 75, 77, 572

[56] References Cited

U.S. PATENT DOCUMENTS

| | | | |
|---|---|---|---|
| 3,412,031 | 11/1968 | Martinek | 252/75 |
| 4,033,892 | 7/1977 | Stangroom | 252/76 |
| 4,129,513 | 12/1978 | Stangroom | 252/78.1 |
| 4,483,788 | 11/1984 | Stangroom et al. | 252/578 |
| 4,502,973 | 3/1985 | Stangroom | 252/73 |
| 4,668,417 | 5/1987 | Goosens et al. | 252/75 |
| 4,687,589 | 8/1987 | Block et al. | 252/73 |
| 4,702,855 | 10/1987 | Goosens et al. | 252/75 |
| 4,744,914 | 5/1988 | Filisko et al. | 252/74 |
| 4,772,407 | 9/1988 | Carlson | 252/74 |
| 4,812,251 | 3/1989 | Stangroom | 252/75 |

FOREIGN PATENT DOCUMENTS 56-83460 7/1981 Japan .

OTHER PUBLICATIONS

Chemical Abstracts, vol. 99, No. 7, AN 52998v, "The Ionic Hydrogen Bond", M. Meot-Ner, 1983.

*Primary Examiner*—Paul Lieberman
*Assistant Examiner*—Christine A. Skane

[57] ABSTRACT

An electrorheological fluid including a discrete phase of the reaction product of a polymeric or monomeric crown either and a quaternary amine, which forms non-abrasive, low density organic fibrils, in a high dielectric strength, low dielectric constant continuous phase fluid. The crown ethers are selected from both oxygen-based and sulfur-based crown ethers.

16 Claims, 7 Drawing Sheets

ELECTRORHEOLOGICAL FLUIDS BASED ON CROWN ETHERS AND QUATERNARY AMINES

RELATED APPLICATIONS

This application is a continuation-in-part of U.S. Ser. No. 486,656 filed on Mar. 1, 1990, now abandoned.

BACKGROUND OF THE INVENTION

1. Field of the Invention

This invention relates to electrorheological fluids, i.e. fluids which exhibit a significant change in flow properties when exposed to an electric field. These fluids are also known as "electric field responsive fluids," "electro-viscous fluids" or "jammy fluids."

2. Background

Early studies of electrorheological fluids (ERFs) were performed by W. M. Winslow who demonstrated that certain suspension of solids (the "discrete," "dispersed" or "discontinuous" phase) in liquids (the "continuous" phase) show large, reversible electrorheological effects. These effects are generally as follows: in the absence of an electric field, electrorheological fluids exhibit Newtonian flow properties; specifically, the shear stress (applied force per unit area) is directly proportional to the shear rate applied (relative velocity per unit thickness). When an electric field is applied, a yield stress phenomenon appears and no shearing takes place until the shear stress exceeds a minimum yield value which increases with increasing field strength, i.e. the fluid appears to behave like a Bingham plastic. This phenomenon appears as an increase in apparent viscosity of several, and indeed many, orders of magnitude.

Electrorheological fluids change their characteristics very rapidly when electric fields are applied or released, typical response times being on the order of 1 millisecond. The ability of electrorheological fluids to respond rapidly to electric signals make them uniquely suited for use as elements in electro-mechanical devices. Often, the frequency range of a mechanical device can be greatly expanded by using an electrorheological fluid element rather than an electro-mechanical element having a response time which is limited by the inertia of moving mechanical parts. Therefore, electrorheological fluids offer important advantages in a variety of mechanical systems, particularly in those which require a rapid response between electronic controls and mechanical devices.

A range of devices have been proposed to take advantage of the electrorheological effect. Because of the potential for providing a rapid response interface between electronic controls and mechanical devices, it has been suggested that these fluids be applied in a variety of mechanical systems such as electro-mechanical clutches, fluid-filled engine mounts, high speed valves with no moving parts, and active dampers for vibration control, among others.

A wide range of combinations of liquids and suspended solids have demonstrated electrorheological effects. The basic ingredients of prior art electrorheological fluids are fine dielectric particles, the surfaces of which typically contain adsorbed water or some other surfactant or both, suspended in a non-polar dielectric fluid having a permittivity of less than that of the particle and a high breakdown strength. As used herein, the term "dielectric" refers to substances having very low electrical conductivity. Such substances have conductivities of less than $1\times10^{-6}$ mho per centimeter. These are general system requirements and accordingly a variety of systems have been found to demonstrate electrorheological effects.

While a number of theories have been proposed to explain the electrorheological effect, a comprehensive theory explaining all of the observed phenomenon has not yet been developed. However, those of ordinary skill in the art are aware that certain system parameters affect the electrorheological response of any given electrorheological fluid. These parameters include, amongst others, the size and concentration of the particles (or discrete phase), the polarizability of the particles, the aspect ratio of the particles in the electric field, the particle surface area, the particle solubility or dispersibility in the continuous phase, the particle porosity and adsorbed moisture, presence of surface activators and surfactants, the rate of shear, the electrorheological fluid temperature and the strength of the applied electric field.

While it is known that the continuous phase should be hydrophobic, experimental evidence suggests that the electrorheological effect is related to water adsorbed to the solid particles or discrete phase. Consequently, early and, indeed, many currently proposed electrorheological fluids include adsorbed water in the discrete phase. For example, U.S. Pat. No. 4,483,788 to Stangroom et al relates to electrorheological fluids comprised of a water-containing polymer such as phenol-formaldehyde polymer as the discrete phase and an oleaginous hydrophobic fluid as the continuous phase. It is specified that a discrete phase content of 25–35% by volume is preferred. However, the electrorheological effect of these fluids using polymers as the discrete phase is limited by the extent of polarizability of the polymeric molecules, the aspect ratio of the polymer in the electric field, the particle size of the polymer, its surface area and the dispersibility of the polymer in the continuous phase.

The scope for practical application of adsorbed water-dependent electrorheological fluids is, however, limited since many devices in which such fluids may be of use are more desirably operated at relatively high operating temperatures and relatively high electric field strengths.

Some efforts have been directed toward developing electrorheological fluids which do not rely upon the presence of adsorbed or free water and which require relatively low electric field strengths. For example, U.S. Pat. No. 4,722,407 to Carlson discloses an electrorheological fluid which includes (1) a dispersed particulate phase of a polarizable solid material which conducts current along only one of its three axes; and (2) a continuous phase of a dielectric liquid. The Carlson electrorheological fluid operates in the absence of free water and is therefore suitable for use at temperatures at which water-containing electrorheological fluids cannot operate because of the evaporation of the water. The electrorheological fluid is also said to require a relatively low electric field strength. The preferred polarizable solid material is lithium hydrozinium sulfate. However, a "stabilizer" is necessary to suspend the lithium hydrozinium sulfate which otherwise tends to settle out in the continuous phase. In the absence of this stabilizer, the lithium hydrozinium sulfate-based electrorheological fluid forms a heavy, flocculated grease. When too much stabilizer is added, the mixture separates into two layers: a sediment layer containing the lithium hydrozinium sulfate and a clear layer. While it is not clear from the Carlson patent, it is known that sulfactants generally increase fluid conductivity resulting in resistive heating of the solution which reduces the electrorheological effect.

U.S. Pat. No. 4,744,914 to Filisko et al discloses an electrorheological fluid which may be used at temperatures in excess of 100° C. (typically about 120° C.) which includes (1) a non-conductive liquid phase; and (2) a crytalline zeolite particulate phase. The preferred zeolite is of the formula:

$$M_{x/n}[(AlO_2)_x(SiO_2)_y]\cdot wH_2O$$

where M is a metal cation or mixture of cations of valence n; x and y are integers and y/x is from about 1 to about 5; and w is a variable. The zeolites of Filisko are dried under vacuum at between about 250° to 350° C. and are not entirely water-free but the residual water does not evolve at operating temperatures. The examples indicate the use of the zeolite in concentrations of 10 to 16 g per 20 ml of liquid phase.

While Filisko does not mention the problem of phase separation often associated with the use of particulates as a discrete phase, it is noted in U.S. Pat. No. 3,412,031 to Martinek et al. The Martinek ERF includes a discrete phase of surface-modified silica gel and discloses that the addition of small amounts of a carboxylic acid has a "slight beneficial effect upon the phase stability of the product formulation." ERF's compounded with carboxylic acids can be stored for long periods of time without separation of the silica. The Martinek invention also requires the addition of a nitrogen-containing organic compound when the ERF is to be activated by a constant potential. Among the listed compounds are the primary, secondary and tertiary amines, aminoethers, aminoalcohols and diamines.

U.S. Pat. No. 4,668,417 to Goossens et al. is directed to an ERF containing silica gel and a polymer as a dispersing agent which prevents or minimizes the settling of the silica and enables ready redispersion of the silica in the event of settling. The disclosed polymers are soluble in liquid hydrocarbons (i.e. the continuous phase) and contain 0.1 to 10% N and/or OH groups, from 25–83% $C_4$–$C_{24}$ alkyl groups and have molecular weights in the range of $5\times10^3$ to $10^6$. Significantly, however, the ERF yet requires the use of about 40 wt. % fine silica, which is an inherently abrasive particle, so that the Goossens ERF may be expected to be abrasive in use.

There yet exists a need for an electrorheological fluid that will operate at the relatively high temperatures encountered in commercial applications that is stable in the sense that the discrete phase will not settle out of the ERF composition, that is non-corrosive and non-abrasive in use, while requiring a low electric field strength to produce a relatively high change in viscosity and wherein the discrete phase is present in low concentration.

SUMMARY OF THE INVENTION

The invention is an electrorheological fluid (ERF) that is responsive to low or high electric field strengths and that is operable at temperatures above the boiling point of water, i.e. the temperatures at which commercial equipment would typically be required to operate. Furthermore, the ERF includes a discrete or dispersed phase that is non-corrosive and non-abrasive.

In the practice of the invention, a crown ether is combined with the salt of a quaternary amine in the presence of a suitable solvent, such as the ethers, hydrocarbons, aromatic hydrocarbons, and alcohols, to produce a reaction product. This reaction product, when added to a high dielectric strength, low dielectric constant fluid, such as a mineral oil, provides an ERF highly responsive to applied electric fields.

The crown ether may be monomeric (i.e. having a single unit of ether) or polymeric (i.e. containing more than one crown ether unit in a typical polymeric chain). In the case of polymeric crown ethers the formation of fibrils, as observed with monomeric crown ethers, may or may not occur. Further, the crown ether may be either soluble or insoluble in a carrier fluid that has a low dielectric constant and a high dielectric strength. The polymeric crown ethers may, for example, be of the formula:

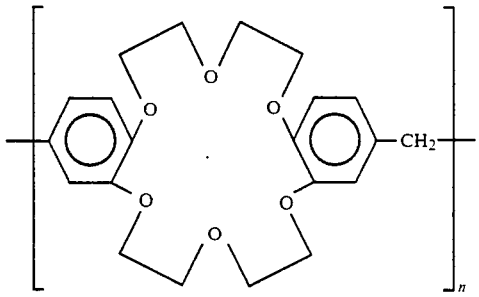

and the like, where n specifies the number of repeating units. In general, any polymeric crown ether that produces an ER effect may be used. The polymeric chain may therefore include only one crown ether or may include several such ethers in the chain. In general, polymeric chains containing at least one crown ether and having equivalent weights up to about 10,000 are useful. Of course, a single or monomeric crown ether is also useful.

Since the invention ERF does not rely upon free or adsorbed water in the discrete phase for operability, the ERF may be used in thermal environments where water-based ERFs would become inoperative due to loss of water by evaporation or otherwise. Furthermore, unlike most prior art ERFs, the novel invention ERF does not contain solid inorganic particulates such as silica particles, zeolites and the like. Instead, the discrete phase includes complexes, usually in fibril form, fibrils of an organic composition that is the reaction product of a crown ether and the salt of a quaternary armine. These fibrils are non-abrasive and non-corrosive and may be remelted and reformed. When the temperatures in excess of about 150° C. are encountered, the fibrils in the fluid melt and/or dissolve, forming an apparently homogeneous solution. Upon lowering the temperature below about 150° C., the molten or dissolved compositions reform as fibrils and the fluid performance is essentially the same as prior to the thermal excursion. This thermal cycling may be repeated with non apparent change in fluid performance occurring. Moreover, since the fibril density approximates that of the typically used continuous phase fluids such as mineral and silicone oils, there is no perceptible phase separation with time so that the ERFs are stable over long periods of time.

The ERF composition may usefully vary from about 1 wt. % fibril content up to about 30 wt. % fibril content when the fibrils are the only discrete phase component, but if the present complexes are not fibrils, the concentration can be as much as about 60 wt. %. Thus, not only is the proportion of discrete phase component lower than that required by prior art ERFs but as a result the inventive ERFs are also less dense than the prior art particulate-based ERFs. This has a significant effect in enhancing the usefulness of the invention ERFs. For instance, the relatively lower concentration and density of the non-abrasive, organic fibrils allows the use of the invention ERFs in applications where the use of large amounts of denser, abrasive particles may be a limitation such as, for instance, in space applications where weight is a major consideration.

As indicated above, the invention ERFs do not rely upon adsorbed water to provide or produce the electrorheological effect and this contributes to their thermal stability. Due to this thermal stability, non-abrasiveness and powerful electrorheological response, the invention ERFs may be used, for example, in the automotive industry as clutch fluids in self-lubricating clutch systems, as clutch fluids in continuously variable transmissions and in shock absorbers. The ERFs may also find use in vibration or acoustic damping systems to disrupt shock or noise harmonics by continuously varying the "cushioning" properties (viscosity) of the ERF by varying the strength of the applied electric field. Thus, for example, the ERFs could be used as shock dampening nuclear power plant coolant pump mounts, active sound-absorbing partitions, building supports in earthquake-prone areas, etc. The invention ERFs may also be usefully employed in cushions, mattresses and seats to provide firmer or softer support as and where needed by suitably arranging the applied field in grids to achieve the desired end.

Thus, the invention organic complex-based ERFs which combine thermal stability, non-abrasiveness, low density and strong electrorheological response are useful in a wider range of applications than heretofore possible with prior art ERFs.

DESCRIPTION OF THE PREFERRED EMBODIMENTS

Figure 1:
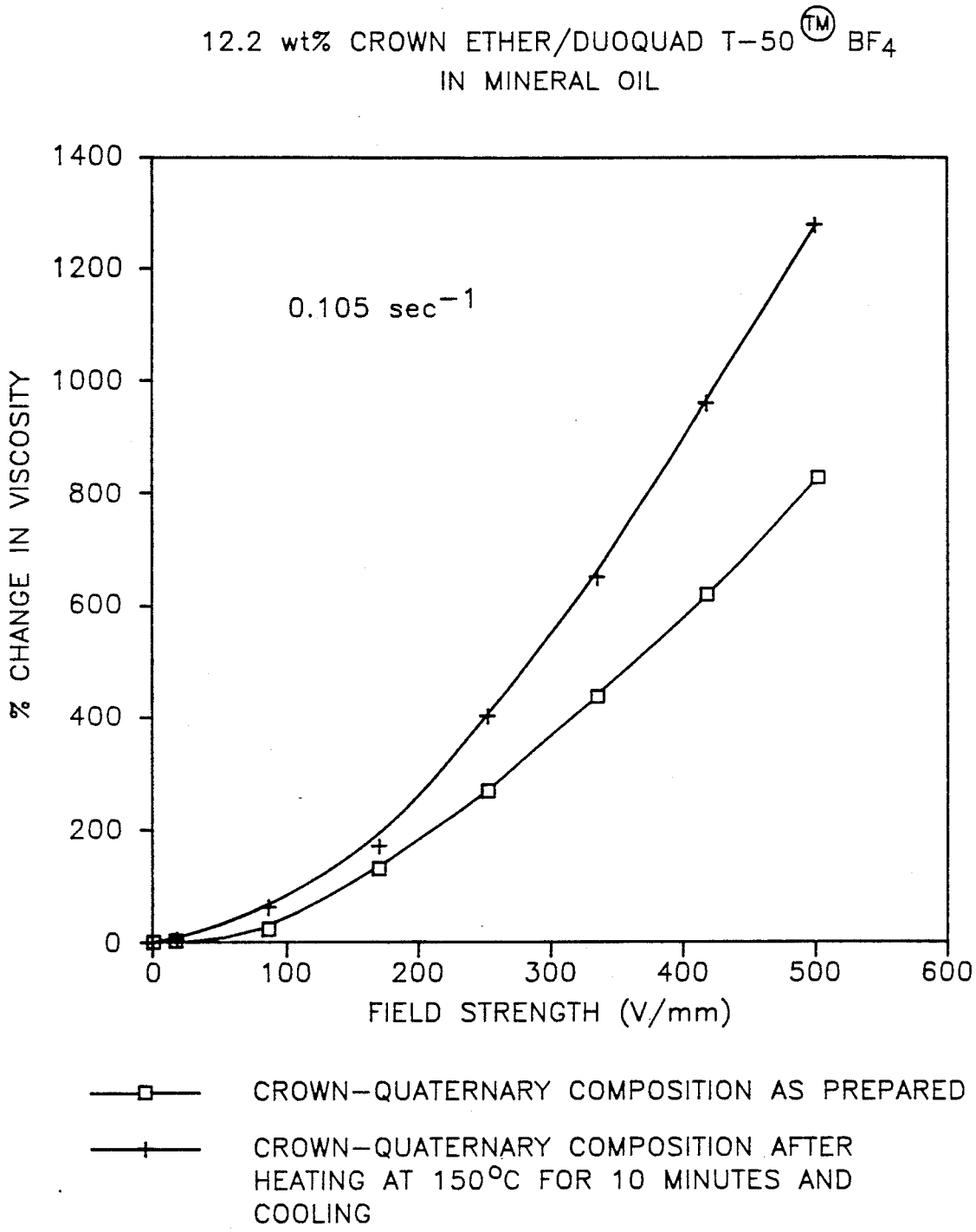
FIG. 1 is a graph showing the ER response of a 12.2 wt. % crown ether—Duoquad T-50 TM composition in mineral oil.

The invention electrorheological fluids for monomeric crown ethers include organic fibrils in a continuous phase high dielectric strength, low dielectric constant fluid. The organic fibrils have a density similar to that of the typically-used continuous fluids so that the phase separation that normally occurs over time in prior art ERFs is substantially eliminated. Furthermore, the invention ERFs do not rely for their operability upon the presence of free or adsorbed water so that they are operative at commercially useful temperatures which often range above the boiling point of water.

The organic, non-abrasive fibrils which form the discrete phase of the invention ERFs may be prepared by reacting a monomeric crown ether or a polymeric chain containing at least one crown ether, with the salt of a quaternary amine in a suitable solvent. This reaction product, in combination with a high dielectric strength, low dielectric constant fluid produces an electrorheological composition.

The term "crown ethers" as used in the claims and specification should be understood to include both monomeric crown ethers (i.e. single crown ether units) and polymeric chains having at least one crown ether unit and possibly several such repeating units. Further, the term "crown ethers" includes the thiacrown ethers wherein sulfur atoms replace the oxygen atoms.

The crown ethers useful in the present invention are those crown ethers having from about 4 to about 10 oxygen atoms in the crown ring, whether substituted or unsubstituted. It is, however, preferred that the crown ethers be selected from those having from 4 to about 6 oxygen atoms in the crown ring. In addition to having crown ethers containing oxygen atoms in the crown ring, crown ethers containing sulfur atoms in the ring are also useful in the invention. An example of such a thiacrown ether, which has been shown to be useful is 1,4,7,10-tetrathiocyclododecane. Thus, thiacrown ethers, of about $S_4$ to about $S_{10}$, preferably about $S_4$ to about $S_6$ are within the purview of the present concept.

The crown ethers may be either monomeric (i.e. having only one crown ether in a molecule of the ether) or polymeric (i.e. having at least one but possibly more crown ethers in a polymeric chain). The crown ethers may be either soluble or insoluble in the low dielectric constant, high dielectric strength continuous phase fluid. The range of useful polymeric crown ethers is not strictly limited by molecular weight but extends to all those polymeric compositions that contain at least one crown ether unit in the chain. Thus, polymeric crown ethers having one crown ether unit are useful as are those having equivalent weights of up to about 10,000. A typical polymeric crown ether, such as methylene dibenzo-18-crown-6 polymer, may be represented by the formula:

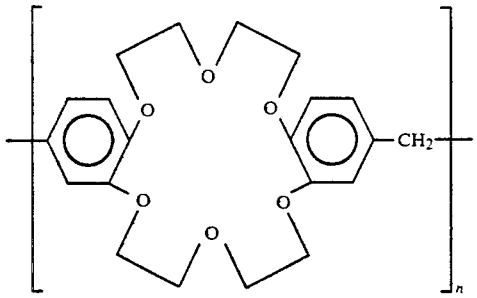

where n specifies the number of repeating units.

The salts of a range of quaternary amines are useful in the present invention. Both monoquaternary and diquaternary amines have been found to be useful in the invention. Since the postulated mechanism involves the interaction of the positive charge associated with the quaternary group, the length and type (aryl, alkyl) of substituents on the nitrogen is not expected to be critical. In fact, quaternary amines with and without aryl substituents have been utilized. Both upon reaction with a crown ether yield electrorheologically active products. Pyridinium quaternary amines are also included in this group. It is within the purview of the present concept that cations selected from the group containing phosphorus, arsenic, stibine and boron react with a crown ether to provide electrorheological active products. The number of carbon atoms in the quaternary amine can be from 4 to about 50.

The continuous phase component, as mentioned before, may be selected from those fluids having a high dielectric strength and a low dielectric constant. Useful fluids may be selected from those having dielectric constants less than about 40, preferably less than about 35 and most preferably less than about 5. These compositions include polyglycols, alcohols, polyols, hydrocarbons, halogenated hydrocarbons, mineral oils, silicone-based oils and greases, ethers, ketones and the like in either liquid, gel or semi-solid form. However, the continuous phase is preferably selected from mineral oils and is most preferably silicone-based oils. Operating factors such as, for instance, operating temperature, should be taken into account in selecting the continuous phase composition to optimize the ERF composition for particular applications.

In the production of the invention ERF, the fibril composition is produced and combined with the continuous phase fluid. Thus, for example, the ERF may be prepared by combining a crown ether with suitable solvents such as ethers, hydrocarbons, aromatic hydrocarbons, alcohols and the like; more specifically, tetrahydrofuran (thf), hexane, benzene, toluene, diethylether, 1,4-dioxane, and the like; preferably thf, and heating the mixture to dissolve the ether. A quantity of mineral oil, silicone oil or other selected continuous phase fluid is then mixed with, or added to, the crown ether solution. To this mixture is then added a solution of a salt of a quaternary amine, preferably also dissolved in a solvent, preferably also thf, while stirring. After about several minutes of stirring at ambient temperatures, the thf solvent is removed by first heating to about 100° C., then the pressure is reduced to about 0.7 mmHg and heating is continued at about 120° C. for several hours. The organic fibrils which are formed, and which comprise the discrete phase of the invention ERFs, are the reaction product of the crown ether and the quaternary amine. This recovered material is pale in color, is fibrous, and exhibits an ER response when a potential is applied.

To produce the ER effect, an electric field is applied to the ERF composition. The strength of the ER response is related, among other factors, to the concentration of fibrils in the ERF, the selection of the continuous phase fluid and its inherent viscosity. Thus, by suitably selecting between these variables an ERF may be customized for a particular application.

The advantages of the invention organic-fibril-based ERFs may be more readily appreciated by reference to the following non-limiting, illustrative examples.

The viscosities of the ERFs of the following examples were measured using an apparatus which included a Brookfield Model RVT viscometer, a stainless steel cup and a Canberra Model 3002 power supply. The positive lead of the power supply was connected to the steel cup. The negative lead of a thin wire was in contact with the shaft of the viscometer so as to provide continuous electrical contact but not to significantly hinder the rotation of the shaft. The viscometer spindle was located in the center of the cup and was completely immersed in the fluid being tested such that the distance from the bottom of the spindle to the bottom of the cup was greater than the distance from the spindle to the side of the cup. The spindle was isolated from the viscometer drive mechanism by a machined plastic sleeve.

EXAMPLE 1

A 1.2 g quantity of dibenzo-18-crown-6 (dbc) was added to a 50 cc beaker with 35 g of tetrahydrofuran (thf). This mixture was heated to reflux to dissolve the crown ether. As a separate step, 62 g of mineral oil was stirred in a 500 cc round-bottomed flask containing a stirring bar. The dissolved dbc was then added to the stirred mineral oil at ambient temperature and stirring was continued for about 10 minutes. The mixture was then heated to 100° C. to remove the thf (boiling point 68° C.) at atmospheric pressure. The resultant solution was clear and crystals formed after about 30% of the thf had been removed. When most of the thf had been removed, a vacuum was pulled on the mixture which was heated to 120° C. under about 0.7 mmHg pressure. The resulting final product was a suspension of needle-like crystals in mineral oil and was fairly viscous. This material was found to have no ER response when an electrical field was applied.

EXAMPLE 2

Figure 2:
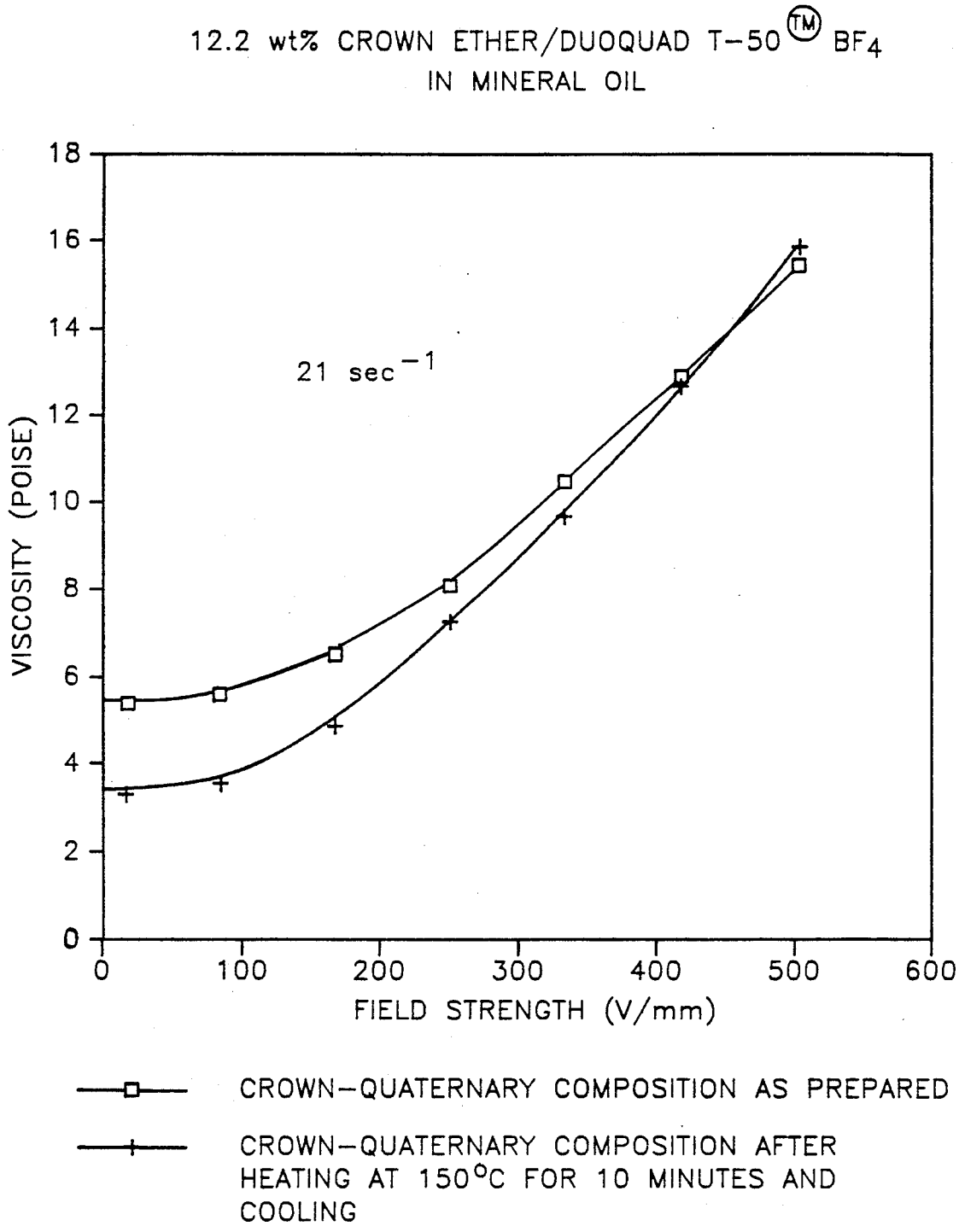
FIG. 2 is a graph showing the ER response of a 12.2 wt. % crown ether—Duoquad T-50 TM composition in mineral oil.

The procedure of Example 1 was followed except that, after the dbc was added to the stirred mineral oil, 7.45 g of Duoquad T-50 TM (Akzo Chemie) as the $BF_4$ salt, which had been dissolved in 35 g of thf with heating, was added to the stirred mineral oil-ether mixture. Stirring continued at ambient temperature for approximately 10 minutes. Thereafter, the mixture was heated to 100° C. to remove thf at atmospheric pressure. This produced a clear solution. After about 30% of the thf had been removed, crystals began to form and the mixture thickened. When most of the thf had been removed, the mixture was heated to 120° C. under about 0.7 mmHg for several hours. The resultant product was a viscous material, pale in color and fibrous in appearance. This material was evaluated for its ER response which is shown in FIGS. 1 and 2.

The same material was left overnight in a closed sample bottle and then reheated to 150° C. for 10 minutes. This caused the fibrous material to melt and/or dissolve. Upon cooling, the fibers reformed. When the material reached room temperature, the ER response was remeasured. This data is also presented in FIGS. 1 and 2.

EXAMPLE 3

The sample of Example 2 was filtered through a coarse glass frit filter under nitrogen atmosphere. The fibril mat obtained, which was light yellow in color, was washed three times with heptane (20 cc). The fibril mat was then transferred to a 250 cc round-bottomed flask with a leg and valve, and placed under about 0.1 mmHg pressure for 48 hours while gently warming with a heating lamp. The material was repeatedly extracted with additional heptane (4 times) to remove any entrained mineral oil. After the final extraction with heptane, the fibrils were dried for 24 hours at about 0.05 mmHg. An electrical field was applied to the filtrate recovered from the above procedure and no ER response was observed.

Figure 3:
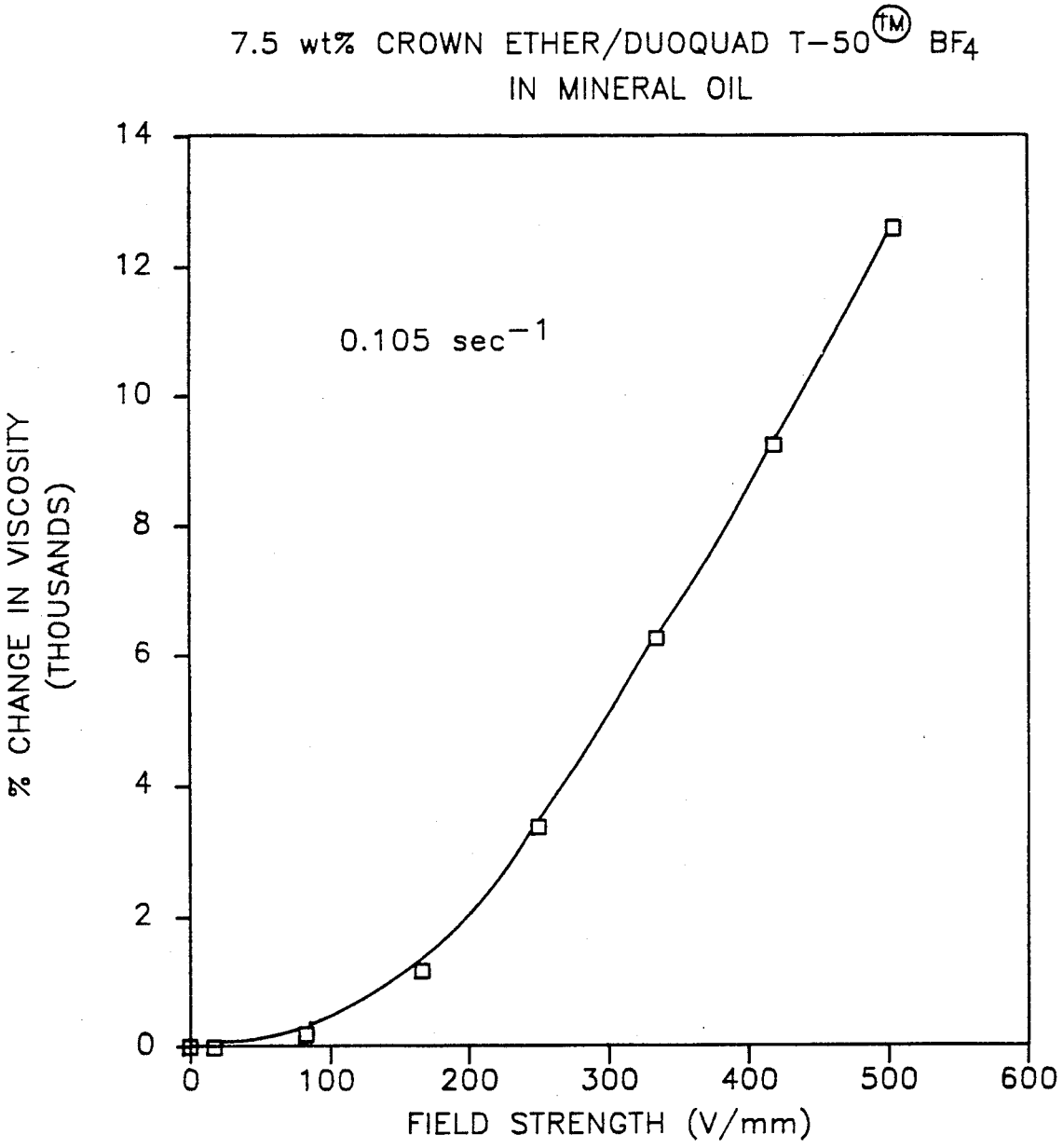
FIG. 3 is a graph showing the ER response of a 7.5 wt. % crown ether—Duoquad T-50 TM composition in mineral oil.
Figure 4:
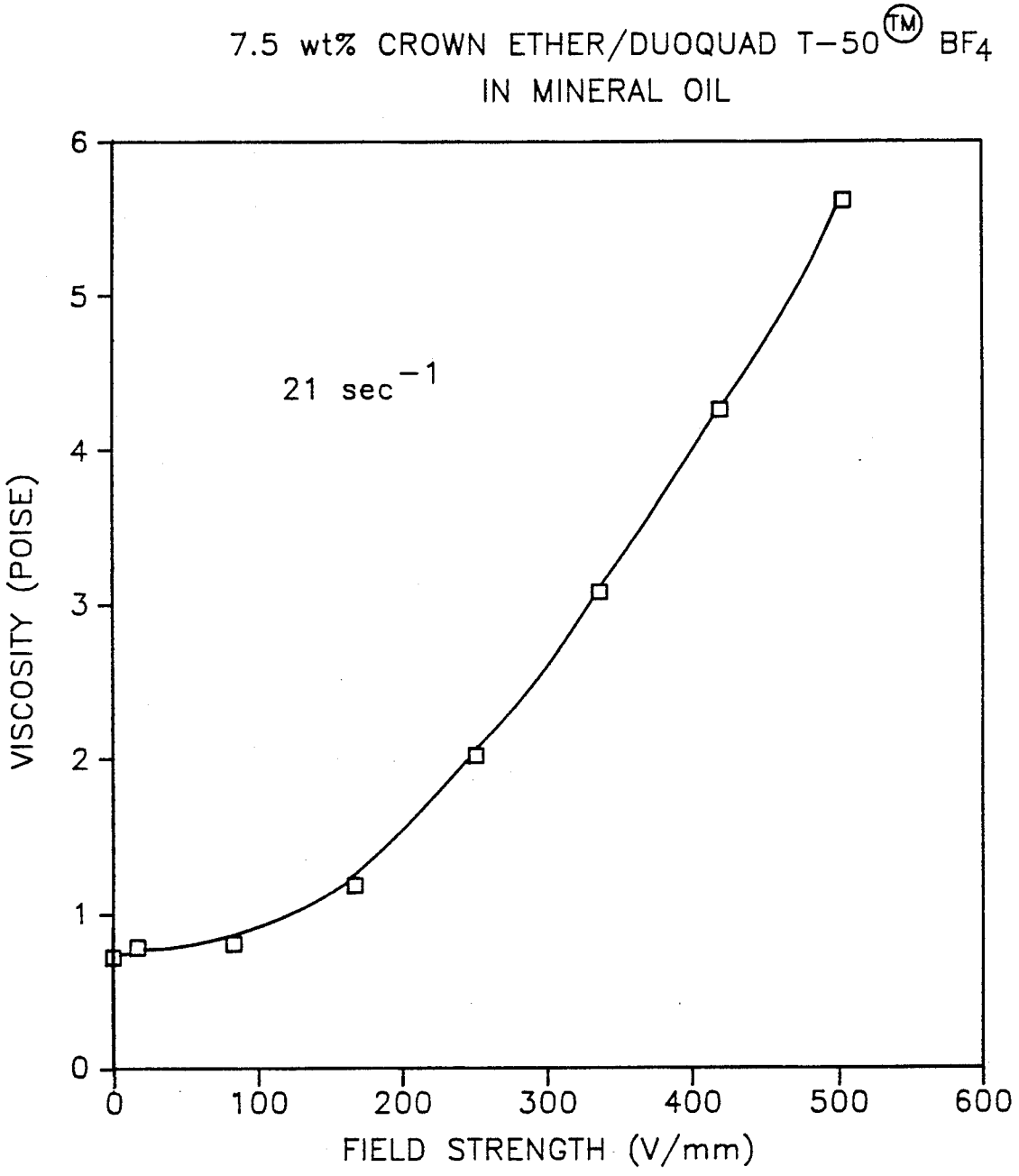
FIG. 4 is a graph showing the ER response of a 7.5 wt. % crown ether—Duoquad T-50 TM composition in mineral oil.

A 35 g quantity of mineral oil was placed in a 500 cc round-bottomed flask with a magnetic stirring bar. To this was added 3.0 g of the dried fibril mat. Stirring was initiated at ambient temperature but only a portion of the fibril mat redispersed. Consequently, thf was added to the mixture to aid in the redispersion. Once complete dispersion had been obtained, the mixture was heated to 100° C. and thf was removed at atmospheric pressure. When most of the thf had been removed, the mixture was heated to 120° C. under about 0.7 mmHg pressure for several hours. The recovered product was a viscous material, pale in color and fibrous in appearance. The resultant fluid was tested for ER response and the data obtained is shown in FIGS. 3 and 4.

From the data obtained in Example 1, it is apparent that a crown ether alone, mixed in mineral oil, does not provide a suitable ERF. From the ER response of the filtrate of Example 3, it is apparent that the organic fibrils are an essential component of the ERF, and that without the presence of these fibrils, a satisfactory ER response is not obtained.

EXAMPLE 4

Methylene dibenzo-18-crown-6 polymer was ground into a fine powder in a mortar. A 3.0 gram sample was then dispersed in Dow-Corning silicone oil DC200-10cs. The suspension contained 42.9 wt. % polymer, the balance being silicone oil. This dispersion exhibited no ER response when tested.

Figure 5:
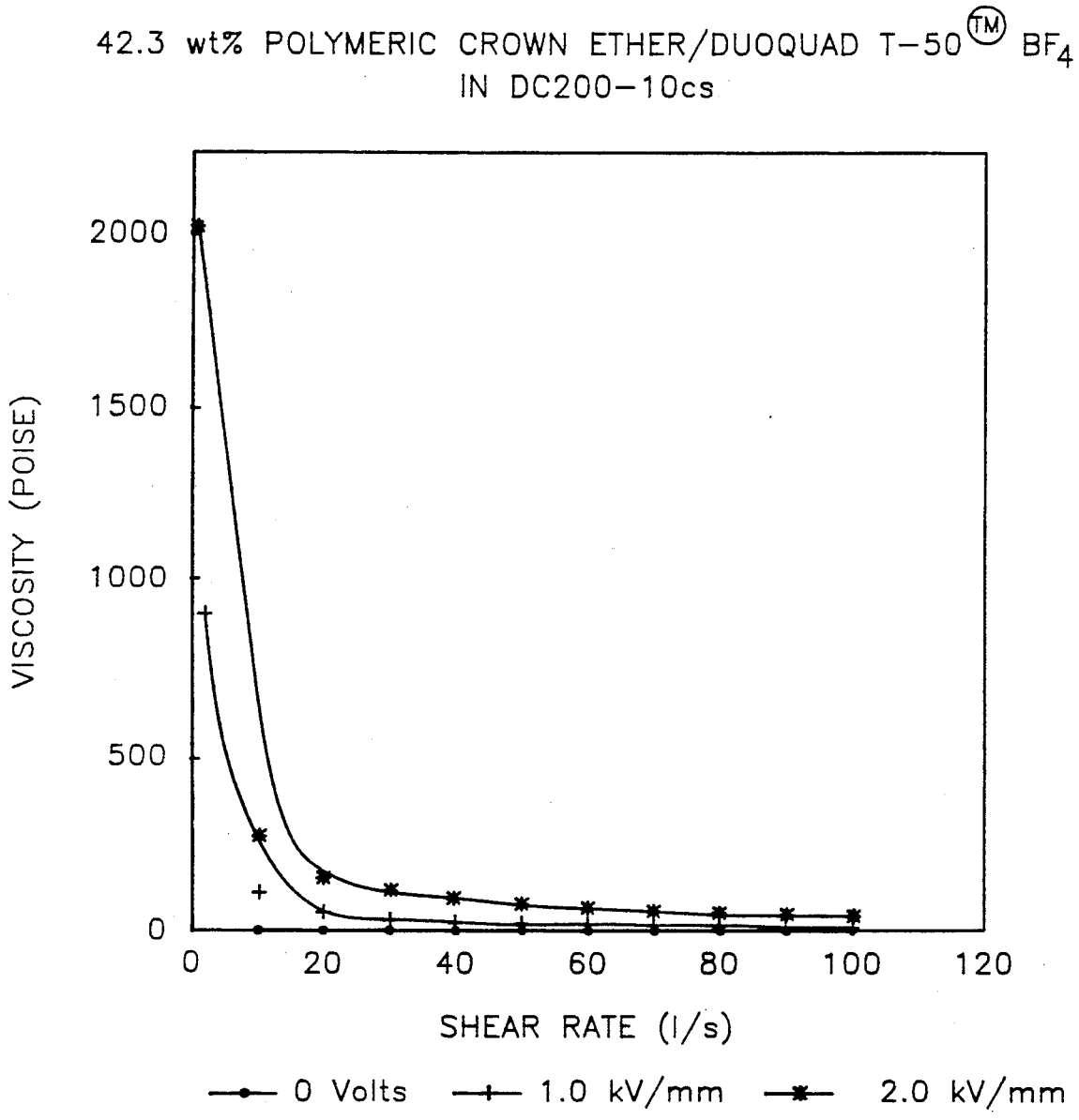
FIG. 5 is a graph showing the ER response of a polymeric crown ether—Duoquad T-50 TM composition in silicone fluid.
Figure 6:
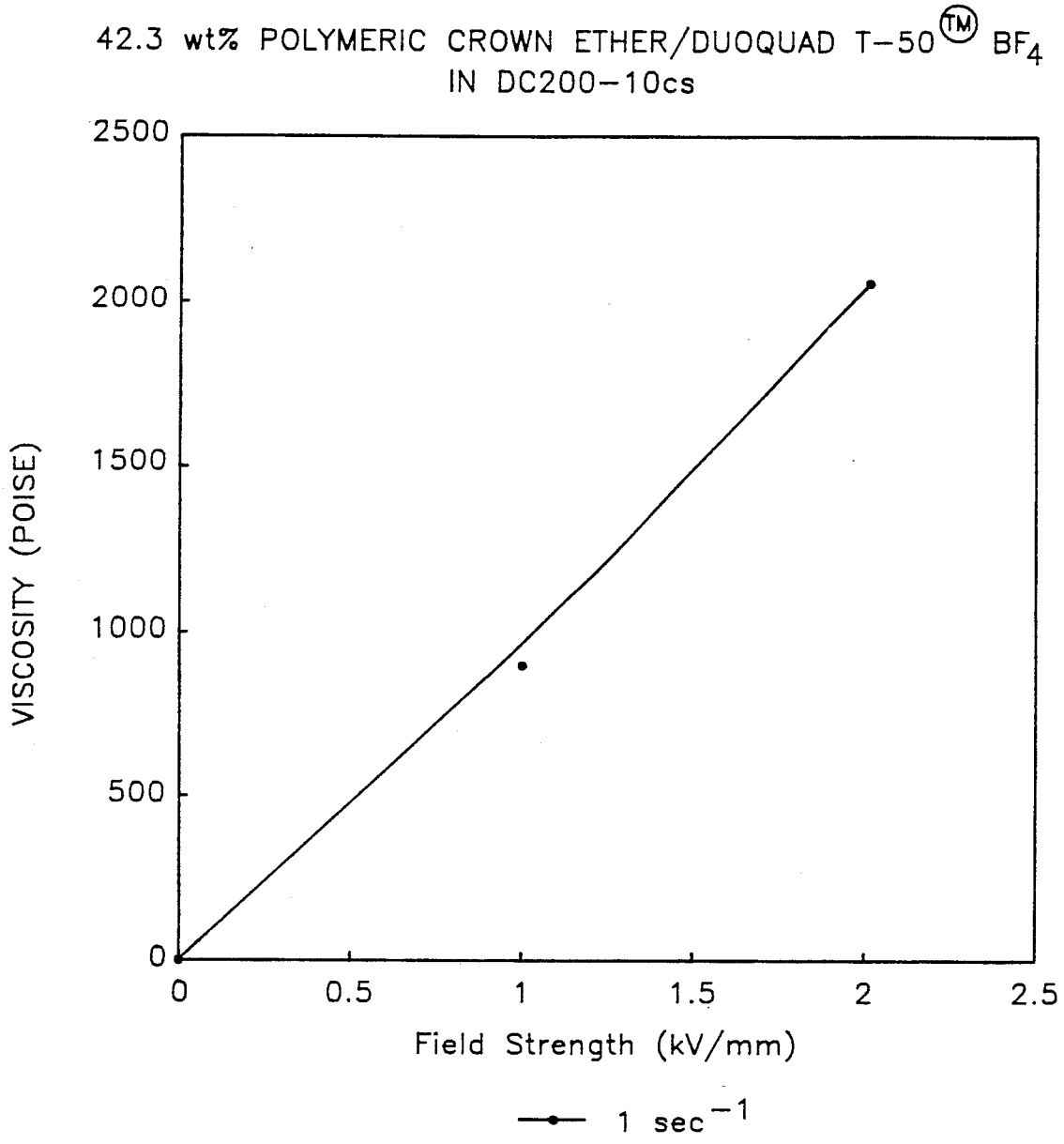
FIG. 6 is a graph showing the ER response of a 42.3 wt. % polymer crown ether—Duoquad T-50 TM composition in silicone oil at a shear rate of 1 $sec^{-1}$.
Figure 7:
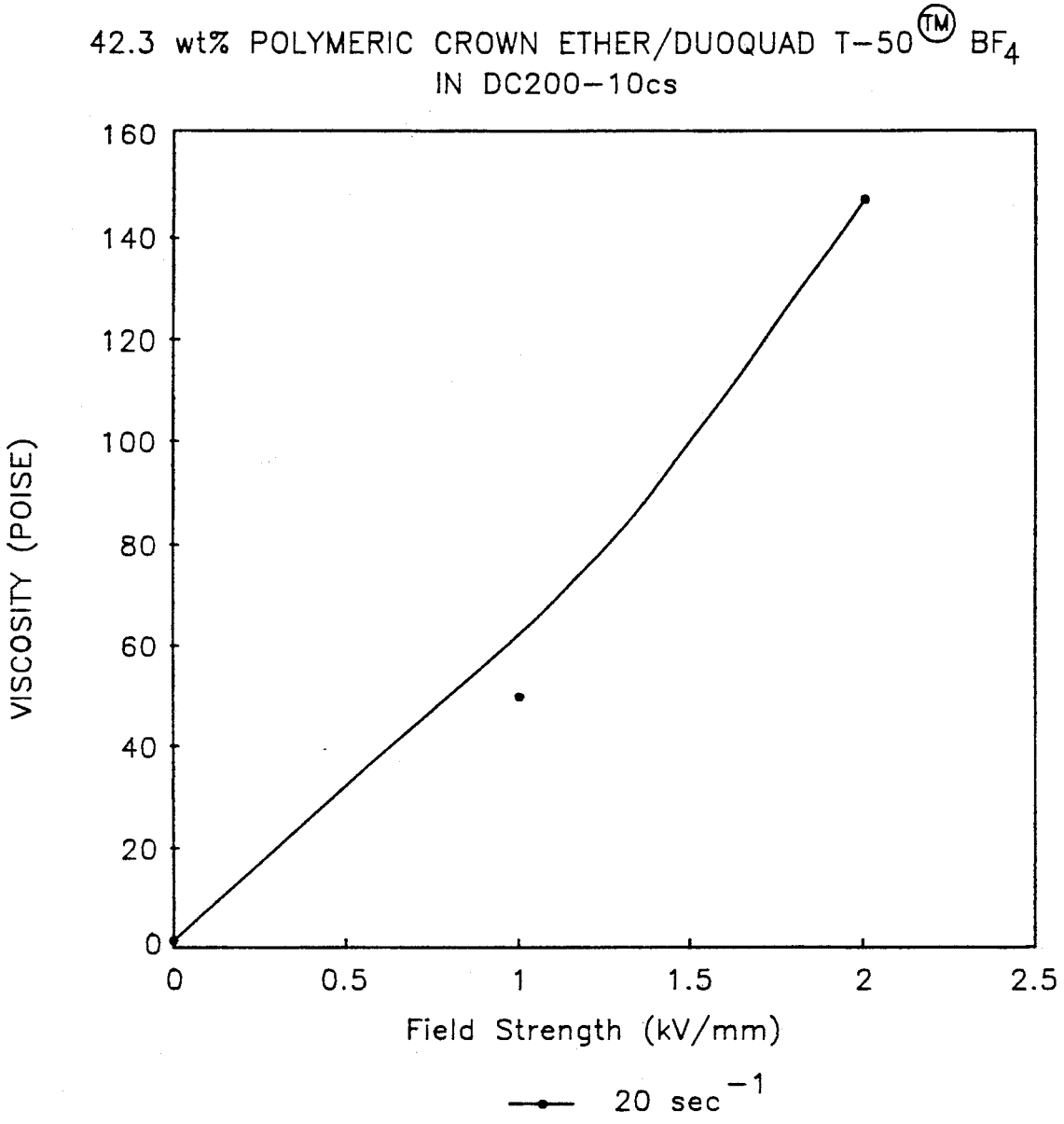
FIG. 7 is a graph showing the ER response of a 42.3 wt. % polymer crown ether—Duoquad T-50 TM composition in silicone oil at a shear rate of 20 $sec^{-1}$.

The mixture was then treated with 2.5 grams of Duoquad TM T-50 $BF_4$ dissolved in 18 grams of tetrahydrofuran. This mixture was heated to reflux while stirring and the tetrahydrofuran was removed by purging with nitrogen. When the resulting mixture became to viscous to stir, it was transferred to a 100° C. vacuum oven where it was held at 30 inches of mercury vacuum for a period of one hour. The sample was then treated with 1.5 grams of Dow-Corning DC200-10cs silicone oil to maintain the same weight percent of solids as in the initial sample which contained only the polymeric crown ether. The ER response of this mixture was then measured at field strengths of 0, 1, and 2 kV/mm and at shear rates of 1 and 20 per second as shown in FIGS. 5, 6 and 7.

From the above, it is clear that polymeric crown ether by itself does not provide an ER response when dispersed in a carrier fluid such as silicone oil. However, reaction of the polymeric crown ether with a quaternary amine provides a product which shows a significant ER response in a carrier fluid such as silicone oil. The particular crown ether used was not soluble in the carrier fluid and did not form fibrils.

Although the invention has been described with reference to its preferred embodiments, those of ordinary skill in the art may, upon reading this disclosure, appreciate changes and modifications which do not depart from the scope and spirit of the invention as described above or claimed hereafter.

What is claimed is:

1. An electrorheological fluid comprising:

(a) the reaction product of a quaternary amine and a crown ether; and (b) a high dielectric strength, low dielectric constant fluid.

2. The electrorheological fluid of claim 1 wherein said crown ether comprises the crown ethers having from about 4 to about 10 oxygen atoms or from about 4 to about 10 sulfur atoms.

3. The electrorheological fluid of claim 1 wherein said quaternary amine is selected from the mono and diquaternary amines having from about 4 to about 50 carbon atoms.

4. The electrorheological fluid of claim 1 wherein said high dielectric strength, low dielectric constant fluid is selected from the group consisting of alcohols, polyols, glycols, hydrocarbons, halogenated hydrocarbons, mineral oils, silicone-based oils and greases, aldehydes and ketones.

5. The electrorheological fluid of claim 4 wherein the low dielectric constant fluid is mineral oil or silicone-based oil.

6. A method of using an electrorheological fluid comprising:

(1) making an electric contact across an electrorheological fluid comprising:

(a) the reaction product of a quaternary amine and a crown ether; and (b) a high dielectric strength, low dielectric constant fluid; and (2) applying an electric field across the electrorheological fluid.

7. The method of claim 6 wherein said quaternary amine is selected from the mono and diquaternary amines have from 4 to about 50 carbon atoms.

8. The method of claim 6 wherein said crown ether comprises the crown ethers having from about 4 to about 10 oxygen atoms or from about 4 to about 10 sulfur atoms.

9. The method of claim 6 wherein said high dielectric strength, low dielectric constant fluid is selected from the group consisting of alcohols, polyols, glycols, hydrocarbons, halogenated hydrocarbons, mineral oils, silicone-based oils and greases, aldehydes and ketones.

10. The method of claim 6 wherein the low dielectric constant fluid is mineral oil or silicone-based oil.

11. A process for producing an electrorheological fluid comprising:

reacting a crown ether with a quaternary amine; and disposing the reaction product in a high dielectric strength, low dielectric constant fluid.

12. The process of claim 11 wherein said reacting is in the presence of a solvent selected from the group consisting of tetrahydrofuran, hexane, diethylether, hexane, toluene, 1,4-dioxane and mixtures thereof.

13. The process of claim 11 wherein said crown ether comprises the crown ethers having from about 4 to about 10 oxygen atoms or from about 4 to about 10 sulfur atoms.

14. The process of claim 11 wherein said quaternary amine is selected from the mono and diquaternary amines having from about 4 to about 50 carbon atoms.

15. The process of claim 11 wherein said high dielectric strength, low dielectric constant fluid is selected from the group consisting of alcohols, polyols, glycols, hydrocarbons, halogenated hydrocarbons, mineral oils, silicone-based oils and greases, aldehydes and ketones.

16. The process of claim 12 wherein said solvent is removed after said reacting.

* * * * *